United States Patent [19]

Furneaux

[11] 4,087,768

[45] May 2, 1978

[54] MODULE FOR CAVITY RESONANCE DEVICES

[75] Inventor: Frederick Arthur S. Furneaux, Toronto, Canada

[73] Assignee: Sinclair Radio Laboratories Limited, Concord, Canada

[21] Appl. No.: 733,108

[22] Filed: Oct. 18, 1976

[51] Int. Cl.[2] ..... H01P 7/00; H01P 7/06

[52] U.S. Cl. ..... 333/83 R; 312/111; 312/257 R

[58] Field of Search ..... 312/111, 198, 203, 257 R; 52/731; 108/107; 333/83 R, 73 W

[56] References Cited

U.S. PATENT DOCUMENTS

| | | | |
|---|---|---|---|
| 2,752,215 | 6/1956 | Peiss | 312/111 |
| 3,131,829 | 5/1964 | Masser | 312/111 |
| 3,182,846 | 5/1965 | La Kaff | 312/257 R |
| 3,222,841 | 12/1965 | Lipof | 52/731 |
| 3,265,935 | 8/1966 | Rosa | 312/111 |
| 3,273,083 | 9/1966 | Rose | 333/83 R |
| 3,497,281 | 2/1970 | Wilde | 312/198 |
| 3,552,817 | 1/1971 | Marcolongo | 312/111 |
| 3,585,768 | 6/1971 | Klein | 52/731 |
| 3,779,623 | 12/1973 | Motohashi | 312/111 |
| 3,811,101 | 5/1974 | Karp | 333/83 R |
| 3,815,311 | 6/1974 | Nisula et al. | 52/731 |
| 3,818,388 | 6/1974 | Hill et al. | 333/83 R |
| 3,899,759 | 8/1975 | Hines et al. | 333/73 W |
| 4,015,545 | 4/1977 | Kurokawa | 108/107 |

FOREIGN PATENT DOCUMENTS

| | | | |
|---|---|---|---|
| 186,388 | 8/1956 | Austria | 312/111 |
| 781,449 | 5/1935 | France | 312/257 R |
| 428,130 | 7/1967 | Switzerland | 312/111 |
| 1,000,140 | 8/1965 | United Kingdom | 312/111 |

OTHER PUBLICATIONS

Product Engineering, Aug. 1945, Mills.

*Primary Examiner*—Paul R. Gilliam
*Assistant Examiner*—Victor N. Sakran
*Attorney, Agent, or Firm*—Shlesinger, Arkwright, Garvey & Dinsmore

[57] ABSTRACT

A module for forming the side walls of a cavity resonance device comprises a metal extrusion shaped in cross-section to be of a rectangular U-shape. The walls forming the free ends of the U are provided adjacent each of their free edges with first shaped portions forming part of the extrusion and extending longitudinally therealong. At least one of the walls forming the U-shape module is provided adjacent each edge of the outer surface of said wall with second shaped portions forming part of said extrusion and extending longitudinally therealong. The first shaped portions and the second shaped portions are respectively designed so that the two first shaped portions of one module may respectively be slid longitudinally into to interfit with, the two second shaped portions of another module to connect such modules mechanically and electrically at each interfitting of a first and a second shaped portion.

12 Claims, 7 Drawing Figures

MODULE FOR CAVITY RESONANCE DEVICES

This invention relates to a module for the formation of cavity resonance devices where two or more of such devices are to be arranged side by side.

By cavity resonance devices are devices for use at between 25 and 1200 Megacycles (from high frequency by microwave frequencies) comprising an outer conductor which is a hollow metallic shell with or without a central conductor. The outer shell may be of many cross-sectional shapes but this invention is concerned with a device where the cross-section is rectangular and most commonly square. Cavity resonance devices fitting the above description and with which the invention might be used include: band-pass filters, band stop filters, wave guides, cavity resonators and transmission line transformers.

Since the invention is designed to provide a modular construction for such devices located side by side it will apply most frequently to such devices as filters, cavity resonators and transformers which are commonly placed side by side and infrequently to wave guides which are usually used singly.

It is an object of the invention to provide a module for use in the assembly of a plurality of side by side cavity resonance devices which module is a metallic extrusion in the shape of rectangular U-shape. (By "longitudinally" in the specification and claims herein, I mean in the direction of extrusion). The free edges of the walls forming the "uprights" of the U are provided with first shaped portions designed to interfit with by sliding longitudinally along second shaped portions provided adjacent each end of the outside of one of the walls of the rectangular U-shaped extrusion. Thus with the two first shaped portions of one module interfitting with pair of second shaped portions of another module results in the provision of a square or rectangular cavity resonance device having three sides from the first mentioned module and a fourth side provided by one wall of the last mentioned module. Three sides of another cavity resonance device, side by side with the first are provided. A number of modules may be assembled in this way if desired. If, with the number of modules assembled, corresponding to the desired number of side-by-side cavity resonance devices, one of the modules has only three sides, the fourth wall may be provided by a separate wall with a pair of second shaped portions.

Since the module is formed from an extrusion, it may be cut to any length desired.

Although the extruded modules may be formed from any extrudable metal with suitable conductivity, the requirements of economy and ease of fabrication will dictate that the metal used is aluminum, brass, bronze or copper—and the preferred one of these is aluminum.

Prior methods of providing multi-section cavity resonance devices (most commonly filters) are as follows:

1. Use separate devices joined with sections of transmission line or joined by welded or brazed waveguide apertures.
2. Use multiple section devices having common walls containing apertures or loops. The whole filter section may be cast from aluminum, bronze or the like.
3. Use multiple section devices with common walls fabricated by making a multiple section extrusion.

4. Use multiple sections formed by providing multiple four sided square or rectangular extrusions placed with side walls of respective sections juxtaposed as closely as possible and connected by aligned apertures in the juxtaposed walls with or without common connecting probes or loops.

Separate devices ((1) above) joined by coaxial cable or wave guides are expensive and inefficient relative to the other devices described. Multiple section devices ((2) and (3) above) having common walls formed by casting or extrusion are relatively efficient and may be economical if the particular shapes chosen are sufficiently in demand to be manufactured in sufficiently large quantities. However, these last mentioned multiple section devices have two principal disadvantages. (a) Such devices are only economical when manufactured in large quantities to a common pattern. Thus such devices are not versatile enough to be used for a large number of different filter (or other resonance device) configurations each having but a limited yearly sales potential. (b) The provision of holes or other coupling means through the common wall between sections of such multiple section devices is difficult and expensive due to difficulty of access. The use of multiple sections formed by four sided sections juxtaposed wall to wall with each other (4) above suffers from the fact that leakage occurs between adjacent juxtaposed walls no matter how precisely they are made or aligned. Moreover such precise manufacture or alignment is expensive. A further disadvantage of the last mentioned method arises from the fact the juxtaposed walls between connected sections require aligned apertures. Such aligned apertures require precision forming which is both difficult and expensive due to the difficulty of access once the sections are connected and the imprecision of alignment when the apertures are separately formed in disconnected sections.

The inventive construction using extrusions having three of the required four walls and forming a rectangular U-shape in cross-section overcomes the disadvantages of the prior methods. The production of multiple sections using the number of such modules corresponding to the number of sections, and with the open sides of the U closed (in at least some cases) by the walls of similar modules, provides multiple sections which are relatively inexpensive and electrically efficient. Moreover the three sided modules are constructed so that they may be easily assembled into a variable number of multiple sections or relatively large variety of multiple sections. The production of special multiple sections in small volume can thus be performed economically. Because three sided modules are used, the connected sections in a multiple section device may always (if desired) be connected by a single wall. In such case there is no problem of leakage between or of alignment of apertures in, double walls.

In the drawings which illustrate preferred embodiments of the invention:

Figure 1:
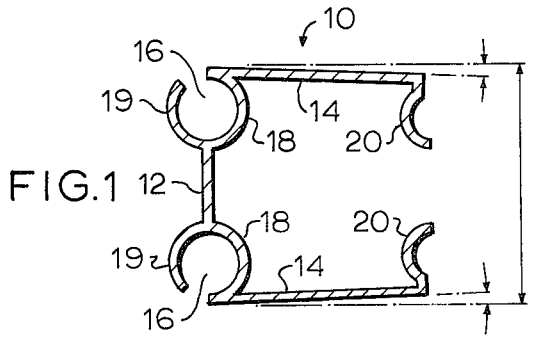
FIG. 1 shows the cross-section of an extrusion in accord with the invention.
Figure 3:
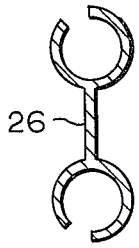
FIG. 3 shows a member for use with modules formed from the extrusion of FIG. 1.
Figure 2:
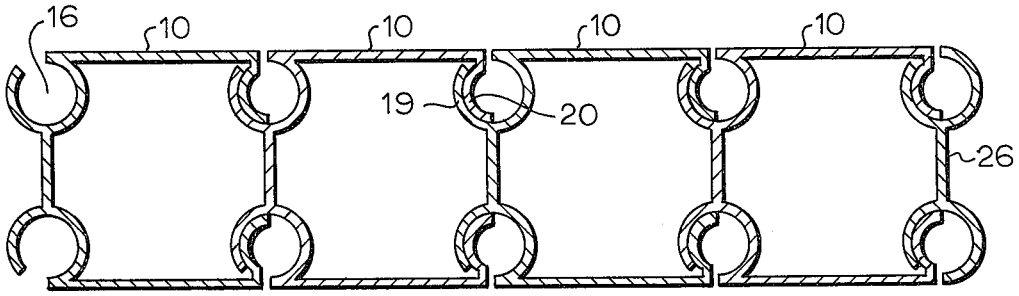
FIG. 2 shows the cross-section of a number of connected modules each formed of the cross-section of FIG. 1.
Figure 5:
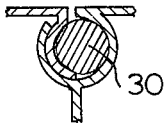
FIG. 5 shows the coupling of members of the type shown in FIG. 4.

In the drawings, FIG. 1 shows an extrusion 10 of generally rectangular U cross-section. At each corner where the wall 12 forming the cross-bar of the U joins a wall 14 forming the upright of the U, the extrusion is shaped to form an outwardly open circular groove 16 with the defining extrusion material 18 and 19 extending approximately three-quarters of the way about of the circle of the groove and with the opening directed outwardly at about 25° to the side walls of the extrusion. It will be noted that the shaped portions are preferably arranged so that the side walls 14 of the extrusion are of smooth contour and the shaped portions only interrupt the end wall 12 or cross-bar of the U-shaped extrusion. The free edges of the walls 14 are provided with shaped portions 20, shaped to complement the circular grooves 16, at the extrusion corners as hereinafter described. The shaped portions 20 on one module are arranged to abut against the outer lip 19 defining the circular groove 16 of another module. The shaped portion 20 is shaped to conform to the curvature of the circular groove adjacent its lip 19. The extensions 20 or "male members" of one module are slid longitudinally into the circular grooves 16 or "female members" of the other member to form the arrangement described and best shown in FIG. 2. It will be obvious that with the embodiment shown the modular form allows the assembly, in a line, of as many sections as desired. The end section will have only three walls and the fourth wall is provided by a plate 26 (shown in FIG. 3) shaped to define at each edge the two circular grooves 18, similar to those on a module so that the plate may be slid longitudinally over and relative to the portions 20 of the open ended module. The circular shape of the grooves 18, (and the conforming shape of the male member 20 are not essential to the invention). For most applications however it is important that the groove defining surfaces define opposed faces on one of which the male member will lie and further define inwardly curved surfaces on each side of the opposed surfaces. This is so that a screw (preferably "thread forming" as distinct from "thread cutting" may be inserted into the passage remaining between the male member and the defining surface of the female member spaced therefrom. The pressure exerted by the screw moves the male member outwardly clamping it firmly against the adjacent surface of the groove defining member thus clamping the two modules firmly together. A similar screw attachment is used to firmly fasten the end plate in place. The action of a screw 24, as above described is shown in FIG. 5. The clamping not only gives good mechanical connection but good electrical connection to properly ensure the electrical qualities of the device. The screw of course is used, not only for clamping but for attachment of the end cap of the device, which will be provided with whatever electrical elements (e.g. probe, loop, central conductor or simple closure) are required for the sections of the multisection device.

Although the modules may be constructed where the male members 20 at the free edges of one module are spaced to conform to the spacing of the female members (grooves 16 defined by extents 18 and 19) so that they may be simply slid longitudinally there into. However it is preferred to shape the extrusion so that the side walls 14 are slightly toed in and hence male members 20 are more narrowly spaced relative to the female members of the module to which the former are to be attached. The 'toe in' of walls 14 is shown in FIG. 1. To connect the male members 20 of one module into the female members of another the male members are spread to obtain the proper spacing before being slid longitudinally therealong. The extrusion must therefore be designed to be sufficiently resilient for bending of the side walls 16 about lines running longitudinally therealong sufficient to allow the necessary spreading of the male members. The result of "spreading" the male members to enter the female members is that the former bear inwardly on the latter creating a better electrical connection The modular shape of FIG. 1 is a single extrusion as is the end member of FIG. 3. Such extrusions may obviously be simply out to any length desired.

The embodiment of FIGS. 1 to 5 is designed to provide any plurality of sections arranged in a line.

Figure 4:
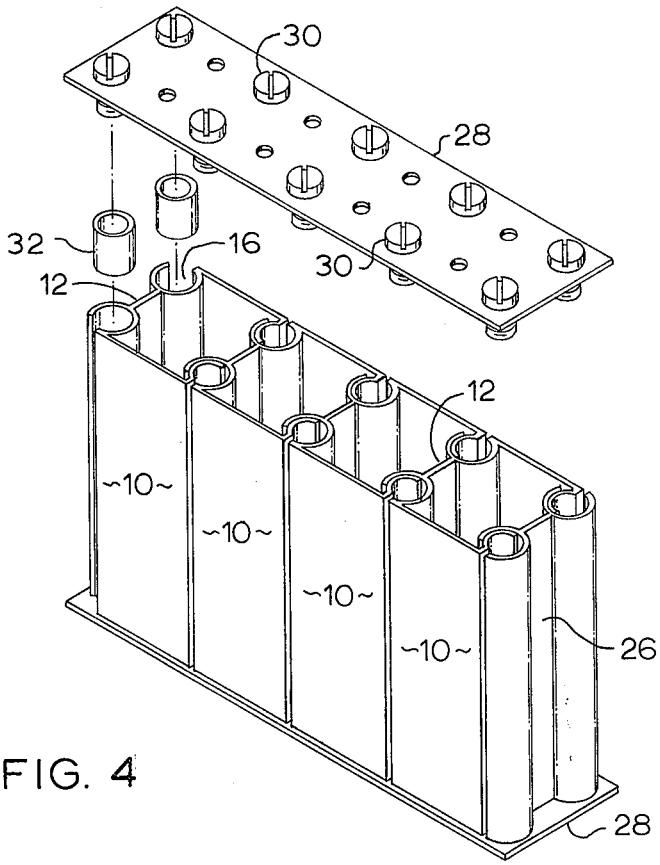
FIG. 4 shows a multi sectional cavity resonance device formed from the extrusions of FIG. 1.

A multi-section device comprising four modular sections is shown in perspective in FIG. 4. The end module which would otherwise define only three side walls of a cavity resonance device is closed by an end member 26 of the type shown in FIG. 3. The four section multi-section device is closed at each end by end caps 28 held in place by screws 30. The screws 30 clamp the extensions 20 against the groove defining members 19 as best indicated in FIG. 5. Since there are no male members 20 in the grooves 16 in the section at the left of FIG. 4 compressible fillers 32 will be used if the screws 30 are to be the same size as the others. It may also be necessary to slightly off set the end holes for screws 30 since these will be concentric with their grooves 16 while the others will not. Any necessary apertures or connections through the common walls between the sections (i.e. walls 12) are made and any connecting equipment is installed before the individual modules are assembled to each other. The end cap may be provided with whatever equipment e.g. probes, loops, central conductors etc are required for the particular sections. These are not shown as they are conventional and well known to those skilled in the art as are the criteria for their design and performance.

Figure 6:
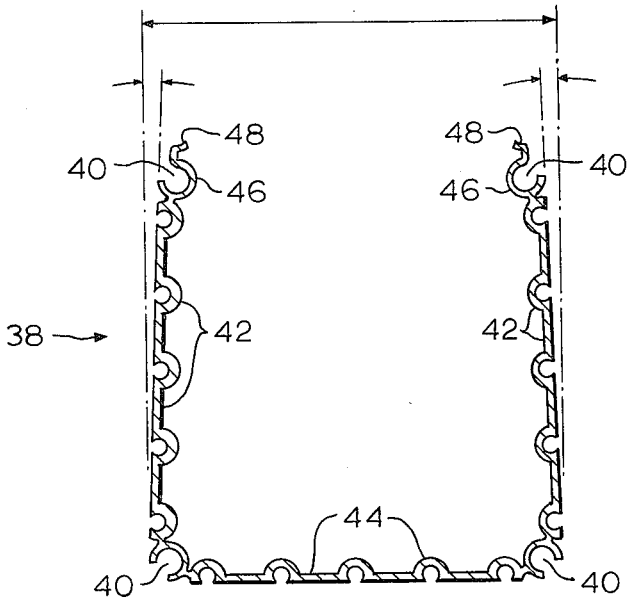
FIG. 6 shows a cross-section of another extrusion in accord with the invention.

The embodiment of FIG. 6 shows a module 38 designed not only to provide end to end multisections as shown in FIG. 6, but also allows the assembly of multisection cavity resonance devices with its U-shaped members arranged in differing orientations.

In FIG. 6 a rectangular U-shaped extrusion is shown. In this embodiment circular grooves 40 whose inner defining surface encompasses about 270° of a complete circle are located, not only at each end of the cross bar or end wall 44 of the U but also at the free edges of the "uprights" of the U or side walls 42. The gap in the shaped portions defining the circular grooves is at substantially 45° to the side walls 42 and end wall 44 of the module (when the side walls 42 are biased to be perpendicular to the end walls). As in the embodiment of FIGS. 1 to 5 the shaped portions defining the circular grooves are arranged so that they do not interrupt the outer contour of the side walls 42.

Figure 7:
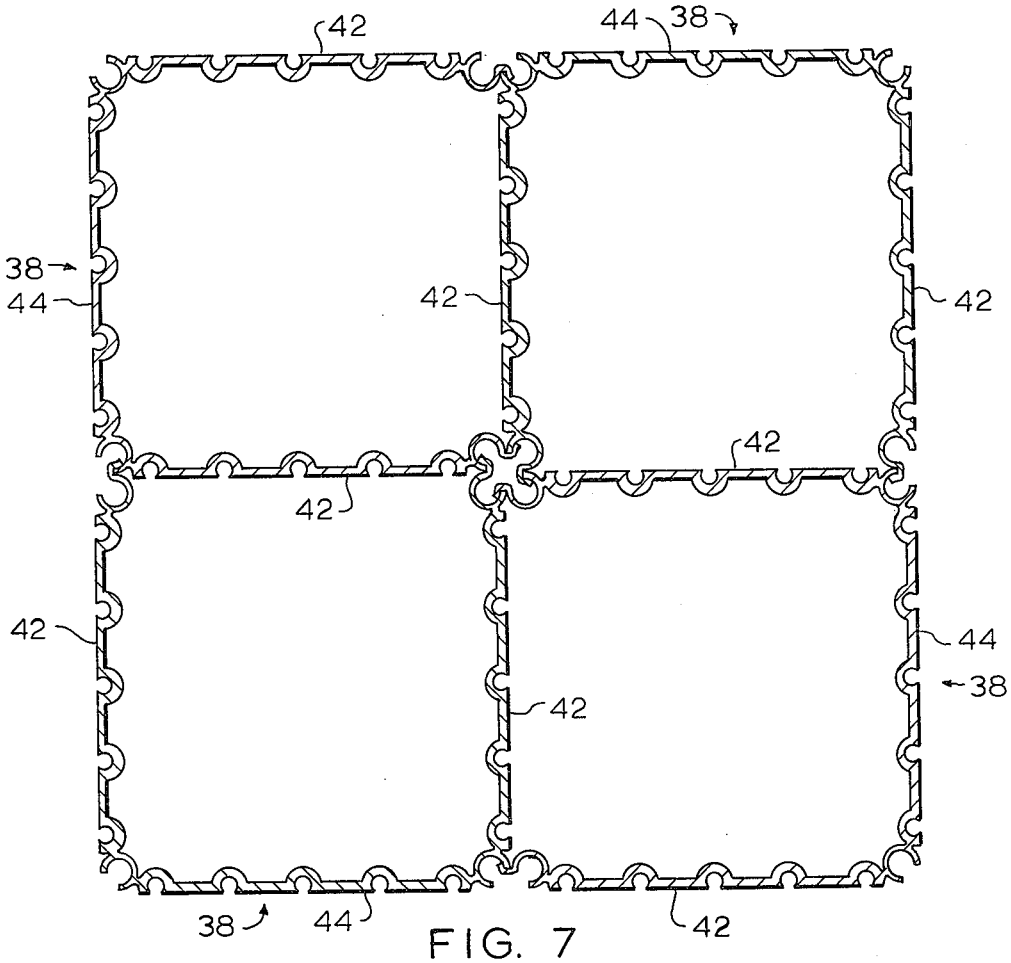
FIG. 7 shows the connection of four extrusions of the type shown in FIG. 6 in the formation of a four section cavity resonance device.

At the free edges of the side walls 42 the inner lip 46 of the shaped portion defining inner extent is provided with a lip 48 extending to curve (oppositely from the lip curvature) over the ends of the lips defining portions of circular grooves 40 and to provide an extent which will rest against the corresponding surface defining the circular groove of another similar module. It will be noted that the two lips 48 or male members may be inserted into pairs of grooves 40 or female members with the modules in the same orientation in the same manner as in the embodiment of FIGS. 1–5 with (and using an fitting end member not shown but analogous to that of FIG. 3). However it will also be noted that the male members 48 on one module may be inserted in the female members at each edge of a side wall 42 of another module so that the side wall 42 of the second module forms the fourth wall of the first module, and the modules are relatively oriented at 90° to each other. Thus an L shaped arrangement of three or more modules may be provided with an end plate on the open end of one of the modules, or four modules may be arranged in a square as shown in FIG. 7. Modules are again connected by longitudinal sliding of the male members of one module into the female members of another.

With the embodiment of FIGS. 6 and 7 it is still considered advantages to have the side walls 22 resilient and slightly toed in (as shown in FIG. 6) to be biassed outwardly to fit in to the female members for good electrical connection.

Again the module 38 is a single extrusion.

Also as with the embodiment of FIGS. 1–5 the second embodiment does not have to define circular contours and circular male members to conform thereto. It is necessary that the inner surface of the female groove encompass a sufficient part of a completed ring that when the male member is inserted therein the outward pressure of a screw will bear in one direction on the male member clamping it on a portion of the defining surface of a female member, while bearing on an opposed female member defining surface to exert the clamping pressure. Also if it is desired to have connected modules oriented at 90° to one another than the female member must have symmetry about a plane at 45° to the end and side walls 42 and 44 of a module when the end and side walls are mutually perpendicular.

Where a module is sufficiently large in dimensions perpendicular to the longitudinal direction, it may be desirable to have screws to hold down the end cap other than at the corners. Provision for extra screws may be provided by the small grooves 48 defined in the extrusion of FIG. 6, such grooves may also be provided in the embodiment of FIGS. 1–5.

End caps may be applied to the embodiment of FIGS. 6 and 7 in a similar manner to the way they are applied to the embodiment of FIGS. 1–5. The end caps will be provided with equipment conforming to the character of the sections to which they are attached. Before assembly the side walls of the modules may be provided with any needed connecting apertures, probes or the like.

The male and female members described are the best way known to me of connecting the modules. However in its broadest aspect of the invention relates to a module for a cavity resonance device which is generally a rectangular or square U-shaped metal extrusion of conducting metal with first shaped portions adjacent the free edges and at least one pair second shaped portions respectively adjacent the opposite end of the outside of a side or end wall shaped to receive the first shaped portions when longitudinally slid thereinto. Thus the module allows the formation of multiple sections when the two first shaped portions of one module are slid longitudinally into the second shaped portions of another module.

I claim:

1. Module for forming the side walls of a cavity resonance device for use at between 25 and 1200 megacycles comprising a metal extrusion whereby there is formed by the said one module and the wall of said another module form an electrical conductor which is a hollow metallic conductor:

shaped in cross-section to be of rectangular U-shape, the walls forming the free ends of the U being provided adjacent each of their free edges with first shaped portions forming part of said extrusion and extending longitudinally therealong, at least one of the walls forming the U-shaped module being provided adjacent each edge of the outer surface of said wall with second shaped portions forming part of said extrusion and extending longitudinally therealong, said first shaped portions and said second shaped portions being respectively designed so that the two first shaped portions of one module may respectively be slid longitudinally into to inter-fit with the two second shaped portions of another module to connect said modules mechanically and electrically at each interfitting of a first and a second shaped portion.

2. A module as claimed in claim 1 wherein said extrusion is made of aluminum, bronze, brass or copper.

3. Module for forming the side walls of a cavity resonance device as claimed in claim 1 wherein said walls are slightly resiliently bendable about lines parallel to the extrusion direction, and said first shaped portions are spaced closer together than the spacing required to interfit with the corresponding second spaced portions, with the wall resiliency being such as to allow the first shaped portions to be spread to allow said first shaped portions be longitudinally slid along the corresponding second spaced portions, whereby the first shaped portions said walls adjacent said free edges which interfit with second shaped portions press inwardly under such resiliency on surfaces of said second shaped portions.

4. Module for forming the side walls of a cavity resonance device as claimed in claim 1 wherein one of each of a first shaped portion and a second shaped portion which are designed to interfit, is a male member and the other is a female member and the design is such that, with the male member in said female member, an aperture is defined extending in the direction of the extrusion for receipt of a screw, said male and female members being so designed that upon insertion of said screw, said male member is clamped firmly against said female member.

5. A module as claimed in claim 3 wherein said extrusion is made of aluminum, bronze, brass or copper.

6. A module as claimed in claim 4 wherein said extrusion is made of aluminum, bronze, brass or copper.

7. A module as claimed in claim 1 wherein a pair of said second shaped portions are located respectively adjacent each corner where a wall forming the upright of a U-shaped extrusion meets the wall forming the cross-bar of such U-shaped extrusion, whereby assembly of two such modules with the first shaped portions, of one module slid longitudinally along the last mentioned second shaped portions of the other module results in the closure of the opening in one U-shaped module by the wall forming the cross-bar in the other U-shaped module.

8. A module as claimed in claim 3 wherein a pair of said second shaped portions are located respectively adjacent each corner where a wall forming the upright of a U-shaped extrusion meets the wall forming the cross-bar of such U-shaped extrusion, whereby assembly of two such modules with the first shaped portions, of one module slid longitudinally along the last mentioned second shaped portions of another module results in the closure of the opening in one U-shaped module by the wall forming the cross-bar in the other U-shaped module.

9. A module as claimed in claim 4 wherein a pair of said second shaped portions are located adjacent each corner where a wall forming the upright of a U-shaped extrusion meets the wall forming the cross-bar of such U-shaped extrusion, where assembly of two such modules with the first shaped portions of one module slid longitudinally along the last mentioned second shaped portions of the other module results in the closure of the opening in one U-shaped module by the wall forming the cross-bar in the other U-shaped module.

10. A module as claimed in claim 1 wherein a pair of second shaped portions are located adjacent opposite ends of at least one wall forming one of the uprights of the U-shaped extrusion, whereby assembly of two such modules with the first shaped portions of one module slid longitudinally along the last mentioned second shaped portions of the other module module results in the closure of the opening in one U-shaped module by the last mentioned wall forming the upright in the other U-shaped module.

11. A module as claimed in claim 3 wherein a pair of second shaped portions are located adjacent opposite ends of a wall forming one of the uprights of the U-shaped extrusion, whereby assembly of two such modules with the first shaped portions of one module slid along the last mentioned second shaped portions of the other module results in the closure of the opening in one U-shaped module by the last mentioned wall forming the upright in the other U-shaped module.

12. A module as claimed in claim 4 wherein a pair of second shaped portions are located adjacent opposite ends of a wall forming one of the uprights of the U-shaped extrusion, whereby assembly of two such modules with the first shaped portions of one module slid along the last mentioned second shaped portions results in the closure of the opening in one U-shaped module by the last mentioned wall forming the upright in the other U-shaped module.

* * * * *